US005175588A

United States Patent [19]

Katagata

[11] Patent Number: 5,175,588

[45] Date of Patent: Dec. 29, 1992

[54] DEVELOPING DEVICE

[75] Inventor: Satoshi Katagata, Hino, Japan

[73] Assignees: Kabushiki Kaisha Toshiba, Kawasaki; Shindengen Electric Manufacturing Co., Ltd., Tokyo; Yamanashi Electronics Co., Ltd., Yamanashi, all of Japan

[21] Appl. No.: 583,554

[22] Filed: Sep. 17, 1990

[30] Foreign Application Priority Data

Sep. 18, 1989 [JP] Japan ..... 1-241116
Sep. 19, 1989 [JP] Japan ..... 1-242822

[51] Int. Cl.[5] ..... G03G 15/06

[52] U.S. Cl. ..... 355/260; 355/200; 355/245; 220/346; 141/364

[58] Field of Search ..... 355/210, 245, 260, 200, 355/215; 222/325, 415, DIG. 1, 108; 141/363, 364, 365, 366; 206/578; 220/346

[56] References Cited

U.S. PATENT DOCUMENTS 4,062,385 12/1977 Katusha et al. ..... 141/89
4,862,210 8/1989 Woolley ..... 355/245
4,949,123 8/1990 Takashima ..... 222/DIG. 1 X
5,040,024 8/1991 Fukuda et al. ..... 355/260

FOREIGN PATENT DOCUMENTS 0285249 10/1988 European Pat. Off. .
60-153065 8/1985 Japan .
61-170760 8/1986 Japan .
0289872 12/1987 Japan ..... 355/260
1-173076 7/1989 Japan .

OTHER PUBLICATIONS

Patent Abstracts of Japan, vol. 9, No. 329, (P-416) [2052] Dec. 24, 1985 Corresponding to Japanese Patent Publication No. 60-153065.
Patent Abstracts of Japan, vol. 13, No. 448 (P-942) [3796] Oct. 9, 1989 Corresponding to Japanese Patent Publication No. 1-173076.
Patent Abstracts of Japan, vol. 10, No. 380 (P-528) [2437] Dec. 19, 1986 Corresponding to Japanese Patent Publication No. 61-170760.

*Primary Examiner*—A. T. Grimley
*Assistant Examiner*—P. J. Stanzione
*Attorney, Agent, or Firm*—Finnegan, Henderson, Farabow, Garrett and Dunner

[57] ABSTRACT

A developing device includes a device body which has a toner reception port and supplies toner stored therein to a photosensitive member, a toner cartridge, which is detachably mounted in the device body in coincidence with the toner reception port, has a toner discharge port opposed to the toner reception port, and supplies toner stored therein to the device body through the ports, a sealing member which is mounted on the device body to surround the toner reception port and seals between the device body and the toner cartridge mounted in the device body, and a pressing mechanism which is provided on the toner cartridge and presses the toner cartridge on the sealing member when the toner cartridge is mounted in the device body.

8 Claims, 12 Drawing Sheets

DEVELOPING DEVICE

BACKGROUND OF THE INVENTION

1. Field of the Invention

The present invention relates to a developing device provided in an electrophotographic recorder.

2. Description of the Related Art

An electrophotographic recorder used as a copying machine, a facsimile, a laser printer, etc. has a charger. an exposure device, a developing device, a transfer device and a fixing device sequentially arranged around a photosensitive drum in its rotating direction. In the operation of the recorder, the photosensitive drum is firstly operated to rotate, the charger charges the surface of the rotating drum, the exposure device exposes the charged surface of the rotating drum to form a latent image, the developing device develops the latent image on the surface of the rotating drum with toner to form a toner image, the transfer device transfers the toner image from the surface of the drum to a recording sheet, and the fixing device fixes the toner image on the recording sheet to record the image on the recording sheet.

The developing device provided in the electrophotographic recorder stores toner in its device body and supplies toner from the device body to the surface of the photosensitive drum. When the toner in the device body is reduced upon use of the toner, toner is supplied into the device body. In one method to supply toner into the device body of the developing device, an exchangeable toner cartridge is used. The toner cartridge storing toner is mounted in the device body and supplies toner into the device body. When the amount of the toner in the device body is reduced below a predetermined value, the toner cartridge is removed from the device body, and a new one is mounted in the device body.

A developing device of a toner cartridge exchange type is constructed as described below. A toner reception port is formed on the upper surface of the device body, and guide rails are provided at both side edges of the toner reception port. Each guide rail has a hook-shaped cross-section, and the guide rails retain both side edges of the toner cartridge from lateral sides and above. A toner discharge port is formed on the lower surface of the toner cartridge. The toner discharge port of the toner cartridge is, for example, sealed by bonding a strip-like sheet.

In mounting operation of the toner cartridge, the toner cartridge is placed on the upper surface of the device body so as to associate both of its side edges with the guide rails and to support both side edges of the toner cartridge with the guide rails from the lateral sides and above. The toner cartridge is then slid along the guide rails to the toner reception port, so that the toner cartridge is mounted in the device body. The externally projected end of the strip-shaped sheet is finally pulled to separate the strip-shaped sheet from the toner cartridge, so that the toner discharge port is opened. Toner stored in the toner cartridge is discharged from the opened toner discharge port into the device body through the toner reception port.

When the toner in the device body needs to be replenished, the empty toner cartridge mounted in the device body is removed from the device body and a new toner cartridge is mounted in the device body. According to this toner cartridge exchange type, toner stored in the toner cartridge can be supplied into the device body without leakage, so that the contamination of scattered toner is prevented.

When the toner cartridge is mounted in the device body in the developing device of the toner cartridge exchange type, if a gap exists between the upper surface of the device body and the lower surface of the toner cartridge, toner in the device body is leaks out through the gap. Therefore, sealing means is provided between the device body and the toner cartridge so as to prevent the gap from being produced therebetween.

A gasket made of sponge and the like is usually disposed on the upper surface of the device body so as to function as the sealing member. When the toner cartridge is placed on the gasket to be mounted in the device body, the gasket seals between the device body and the toner cartridge to prevent the gap from being produced therebetween.

However, the developing device of the conventional toner cartridge type has following various problems.

In the conventional developing device as described above, in order to mount the toner cartridge in the device body, the toner cartridge is placed on the gasket disposed on the upper surface of the body to insert the side edges of the toner cartridge into the pair of guide rails formed in the device body and to retain both side edges of the toner cartridge from above by the guide rails. The toner cartridge is then slid along the guide rails to coincide with the toner reception port of the device body.

In order to securely bring the lower surface of the toner cartridge into close contact with the gasket disposed in the device body, it is necessary to press the gasket from above with the toner cartridge. For this reason, the height of the guide rails for retaining the toner cartridge is so regulated that the toner cartridge is retained from above by the guide rails at a position in which the gasket is compressed in a predetermined value by the toner cartridge.

With the above described conventional construction, while side edges of the toner cartridge are interposed between the guide rails and the gasket reaction force generated upon compression of the gasket is applied to the both side edges of the toner cartridge.

Therefore, a strong frictional force is applied to the toner cartridge when the toner cartridge is slidably inserted into and discharged from the guide rails. In order to slide the toner cartridge against the strong frictional force, the mounting and removing operation of the toner cartridge to and from the device body needs strong force and the strong force makes the above operation troublesome.

In order to ease the above operation, it is considered that the compression amount of the gasket by the toner cartridge is reduced. In this case, when the toner cartridge is inserted into the guide rails in a state that the toner cartridge is inclined to the guide rails due to the dimensional difference of the guide rails and the cartridge in the production, a gap may be generated between the toner cartridge and the guide rails so that the sealability between the toner cartridge and the device body becomes insufficient.

SUMMARY OF THE INVENTION

It is an object of the present invention to provide a developing device in which a toner cartridge can easily slide when a toner cartridge is mounted in and dismounted from a device body of the developing device, and which can securely seal between the toner cartridge and the device body when the toner cartridge is mounted in the body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIGS. 1 to 3 are side, plan and front views showing a state in which a toner cartridge is mounted in a device body;

FIGS. 4 and 5 are side views showing the mounting operation of the toner cartridge in a device body, in the former of which the toner cartridge has not yet been mounted into the device body, and in the latter of which the cartridge has been mounted into the body;

FIG. 6 is a perspective view showing the toner cartridge;

FIGS. 7 to 9 are side, front and plan views showing a pressing mechanism provided as a part of the toner cartridge;

FIG. 10 is an enlarged perspective view showing a part of a pressing lever of the pressing mechanism;

FIG. 11 is an enlarged perspective view showing a part of the device body and a part of the toner cartridge, in which the cartridge has not yet been mounted into the body;

FIG. 12 is a perspective view of a cover; and

FIGS. 13 and 14 are plan views showing the use of the cover on the device body, in the former of which the cover has not yet being mounted on the body, and in the latter of which the cover has being mounted on the body.

DETAILED DESCRIPTION OF THE PREFERRED EMBODIMENTS

Figure 1:
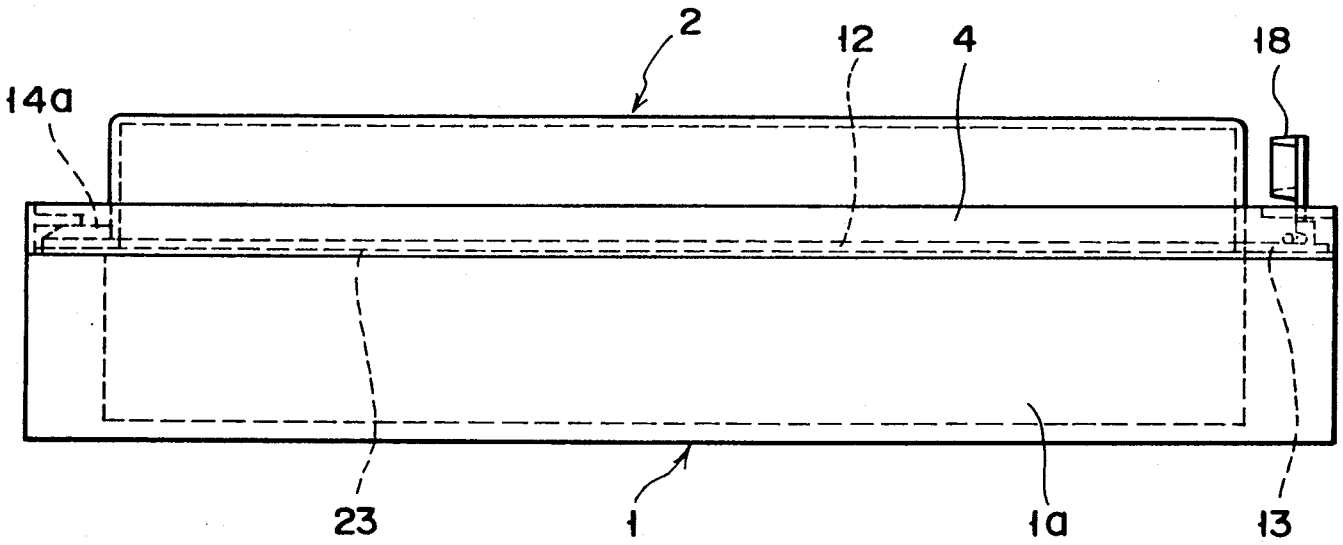
FIGS. 1 to 14 show an embodiment of a developing device according to the present invention.
Figure 2:
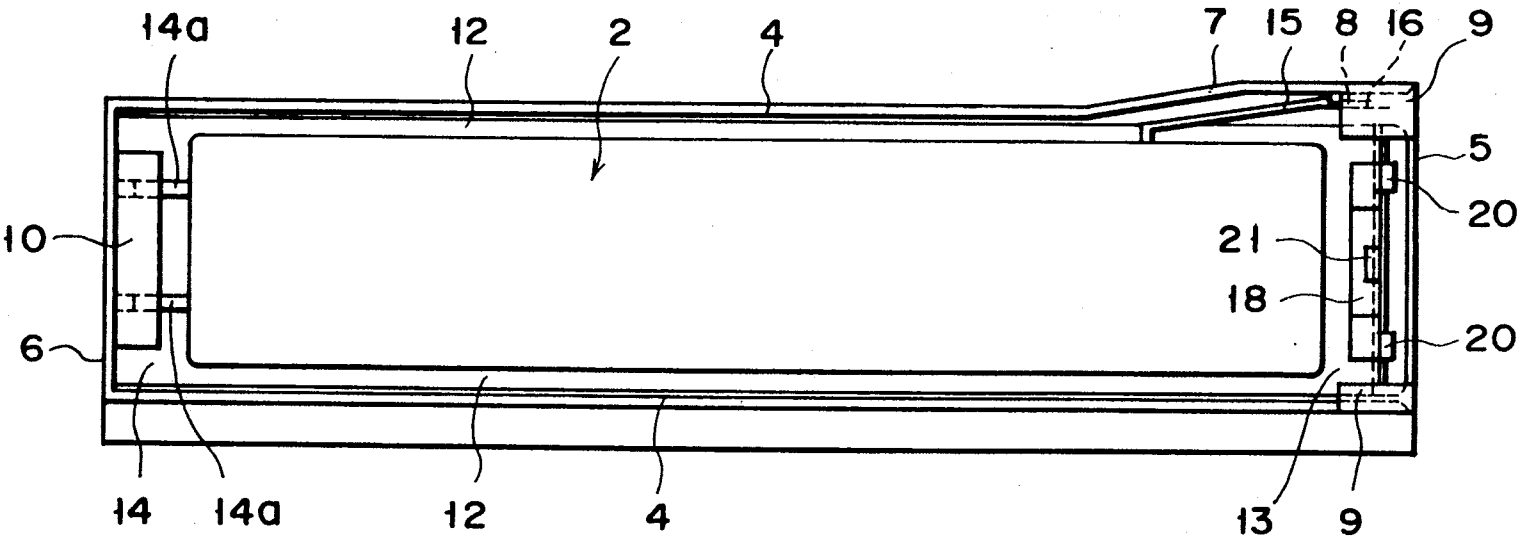
Figure 3:
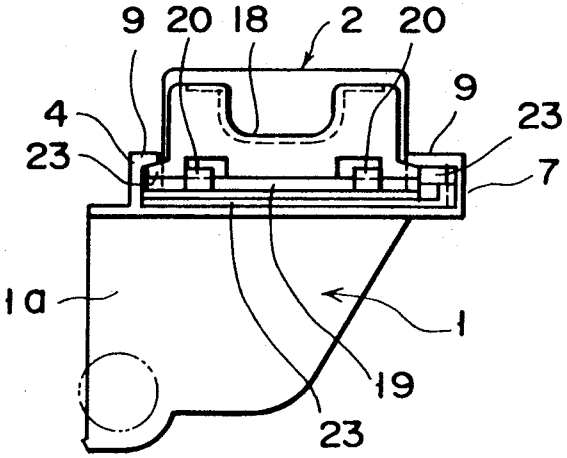

FIGS. 1 to 11 show an embodiment of a developing device according to the present invention. In the developing device of this embodiment, a toner cartridge which has a toner discharge port formed at its lower surface is slidably mounted on the upper surface of a device which has a toner supply port formed in its upper surface. This developing device is provided in an electrophotographic recorder.

In the drawings, reference numeral 1 denotes the device body, reference numeral 2 denotes the toner cartridge, both of which are made of synthetic resin.

As shown in FIGS. 1 to 3, 9 and 11, the device body 1 has a case 1*a* shaped like a laterally elongated hopper, and a laterally elongated toner reception port 3 is formed at the center of the upper plate of the case 1*a*. A pair of guide rails 4 are formed at the longitudinal side edges of the upper plate along the longitudinal sides of the toner reception port 3, and the guide rails 4 protrude upwardly from the upper plate to slidably support the toner cartridge 2. The guide rails 4 are formed in a strip shape for laterally retaining the flanges 12 formed at both side edges of the toner cartridge 2. At one end of the upper plate of the case 1*a*, a toner cartridge mounting port 5 is defined by the upper surface of the upper plate 1 of the case 1*a* and the inner side surfaces of the guide rails 4 at the other end of which and a stopper 6 is formed to bridge over both the guide rails 4.

One guide rail is extended in parallel with the other guide rail except at one end portion thereof. One end portion of the one guide rail is composed of an oblique portion extending obliquely externally from its parallel portion, and a short parallel portion extending parallel with the parallel portion from the external end of the oblique portion. The short parallel portion is a wide portion 7 broading the width between the paired guide rails 4. A tapered surface 7*a* is formed at the rear end of the inner side surface of the short parallel portion of the wide portion 7, and a projection 8 projecting inwardly is formed at a position near the rear end on the inner side surface. Retainers 9 are formed at the upper portion on the inner side surface of one end of one guide rail 4 (i.e., at the upper portion on the inner side surface of the extending end of the wide portion 7) and at the upper portion on the inner side surface of one end of the other guide rail 4. The paired retainers 9 are projected toward the toner cartridge mounting port 5 at a position separated from the upper surface of the upper board by a predetermined high level, and extend horizontally in parallel with the upper surface of the upper board with their projected edges facing each other. A horizontal retaining piece 10 projects from the upper portion of the inner side surface of the stopper 6.

A toner supply port (not shown) is formed at the lower surface of the device body 1. A gasket 23 is disposed at a portion, surrounded by the guide rails 4, the toner cartridge mounting port 5 and the stopper 6, on the upper surface of the upper plate of the device body 1 so as to enclose the toner reception port 3. The gasket 23 is formed into a sheet from a material having elasticity to be compressed or recovered in thicknesswise direction such as sponge, etc., and has a predetermined thickness when a load has not yet applied on the gasket 23.

As shown in FIGS. 1 to 6, the toner cartridge 2 has a laterally elongated case 2*a*, and a laterally elongated toner discharge port 11 is formed at the lower plate portion of the case. Flanges 12 are formed at both side edges of the toner discharge port. Flanges 12 horizontally and externally project, longitudinally extend, and are used to be slid on or engaged with the inner side surfaces of the guide rails 4 of the device body. Flanges 13 and 14 are projected from the outer side surfaces of both end portions of the lower plate to bridge between both end portions of the flanges 12. A pair of rising pieces 14*a* are formed on the upper surface of the flange 14 of the other end portion (front portion) of the toner cartridge 2 so as to be laterally spaced from each other, the paired rising pieces 4 extend in the longitudinal direction of the toner cartridge 2. It is preferable that the front ends of the upper surfaces which is to be in contact with the flange 10 are tapered.

An elastic arm 15 is connected at its base portion to a portion of one flange 12 located near the rear flange 13. The elastic arm 15 has an elasticity to spread externally backwardly and the extended end thereof is in parallel with the flange 12. A tapered surface 15*a* is formed at the extended end of the outer side surface of the extended end portion of the elastic arm 15, and a recess 16 is formed at a portion near the extended end. After the toner cartridge 2 (i.e., the case 2*a*) is filled with toner from the toner discharge port 11, the toner discharge port 11 is covered with a strip-shaped sheet 17, and the sheet is bonded to the lower surface of the lower plate of the case 2*a*. Therefore, the toner filled in the toner cartridge 2 will not leak out from the toner discharge port 11. The strip-shaped sheet 17 has a length twice as large as the length of the toner discharge port 11 of the toner cartridge 2, approximately half of the length is bonded to the lower surface of the case 2*a*, and the no-bonded portion is folded at the front end side of the toner cartridge 2 to be overlapped on the lower side of the bonded portion.

Figure 9:
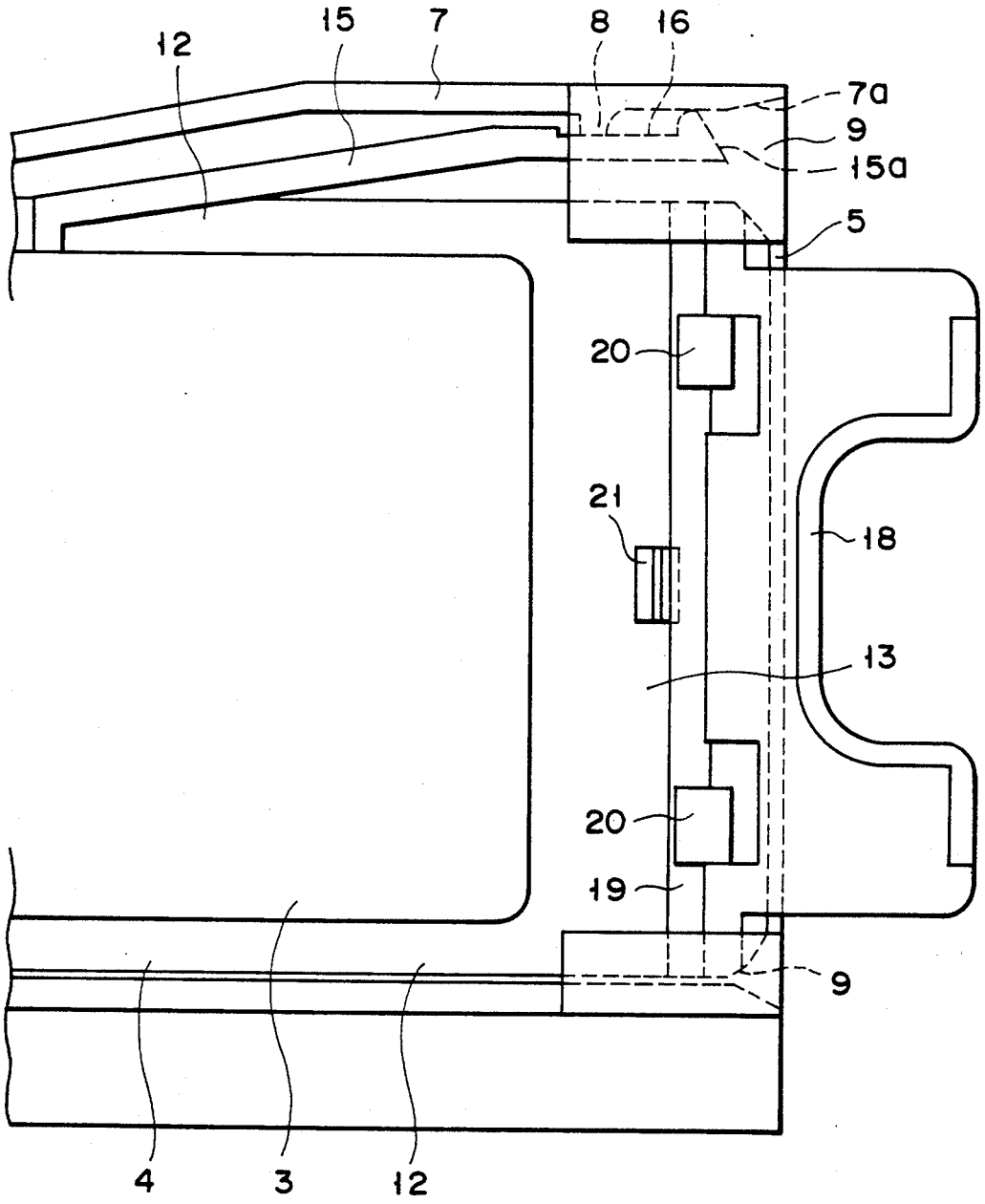
Figure 10:
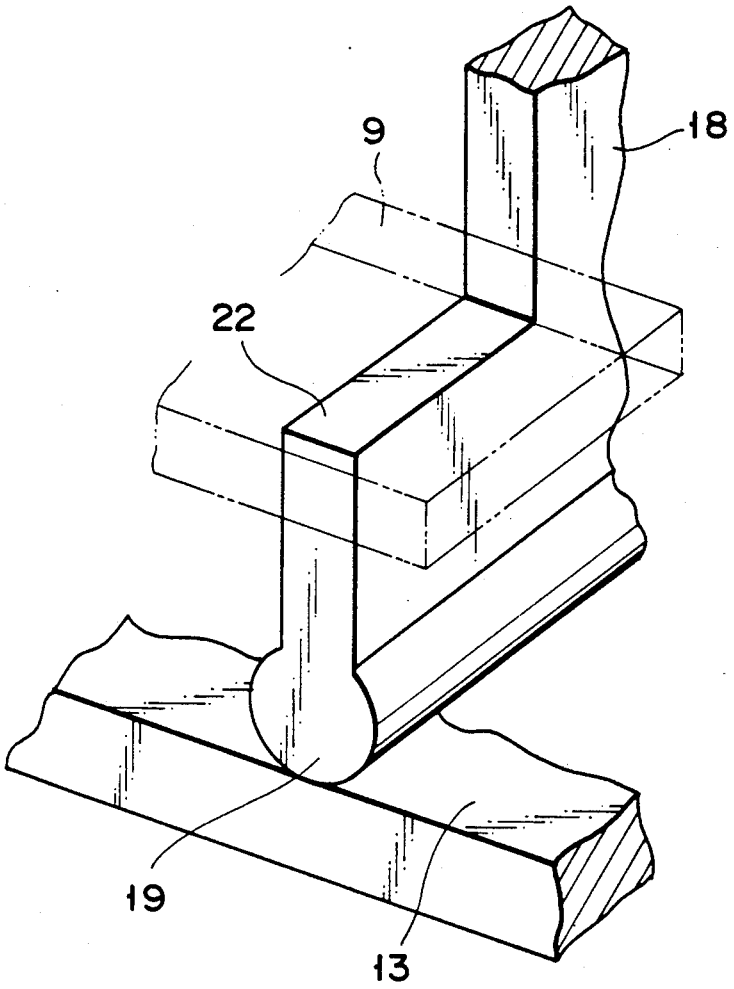
Figure 11:
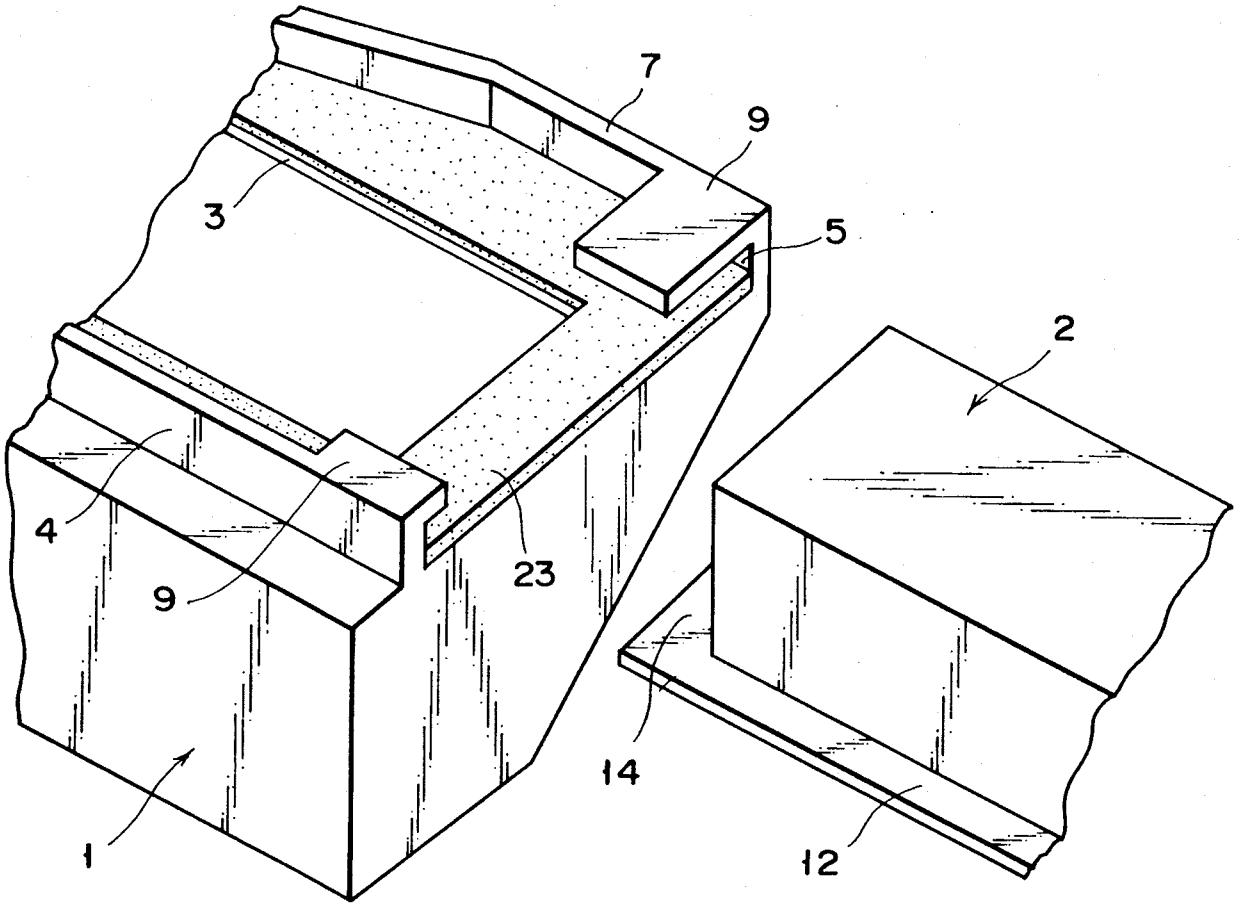

A pressing lever 18 is provided on the rear flange 13 of the toner cartridge 2. As shown in FIGS. 9 to 11, the pressing lever 18 has a base portion having length which is over the entire width of the flange 13, and a shaft 19 is integrally formed with the base portion to extend along the base portion. The pressing lever 18 arranges its shaft 19 on the flange 13, and extends in the axial direction of the flange 13. A pair of shaft retainers 20 project onto the upper surface of the flange 13, and these shaft retainers 20 retain the shaft 19 at the both ends of the width direction separated from each other. A shaft support 21 for supporting the shaft 19 from below is formed at the center portion of the upper surface of the flange 13. The combination of the paired shaft retainers 20 and the shaft support 21 rotatably retain the shaft 19 of the pressing lever 18 so as to rotate it around the horizontally axial line extending in the width direction of the cartridge, so that the entire pressing lever 18 is held on the flange 13 to be rotatable between a vertical position and at which the pressing lever 18 is fallen rearwardly of the flange 13.

Figure 8:
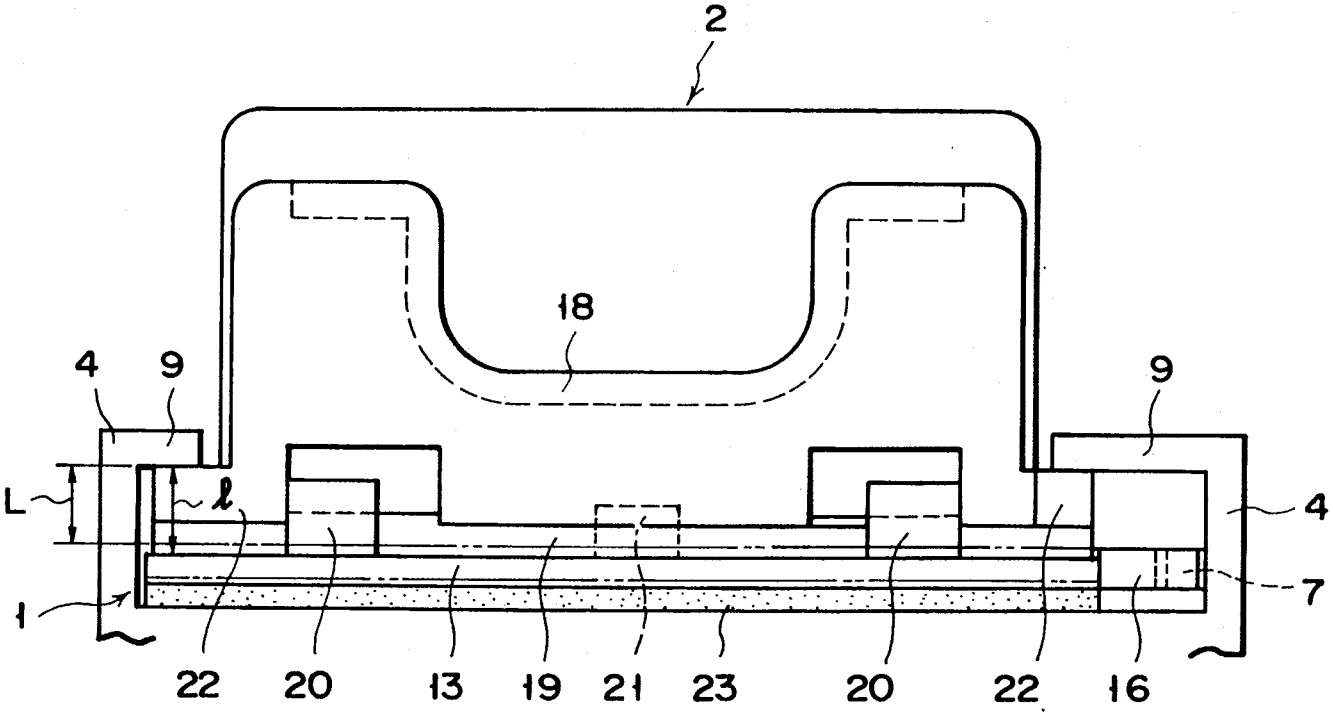

The both side end portions of the base portion of the pressing lever 18 project from the upper end portion thereof to form shoulder portions 22. The shoulder portions 22 are brought into contact with the lower surfaces of the retaining pieces 9 formed at the guide rails 4 of the device body 1 when the pressing lever 18 is erected to the vertical position, and press the flange 13 of the toner cartridge 2 on the upper surface of the gasket 23 provided on the device body 1. Thus, a distance l between each shoulder portion 22 and the lower end of the shaft 19 is, as shown in FIG. 8, so set that it is longer than a distance L between the upper surface of the flange 13 of the toner cartridge 2 and the lower surface of the each retaining piece 9 when the toner cartridge 2 is placed on the gasket 23, and this difference (l−L) is so set that the toner cartridge 2 can compress the gasket 23 in a predetermined value enough to produce sufficient shielding effect.

Figure 12:
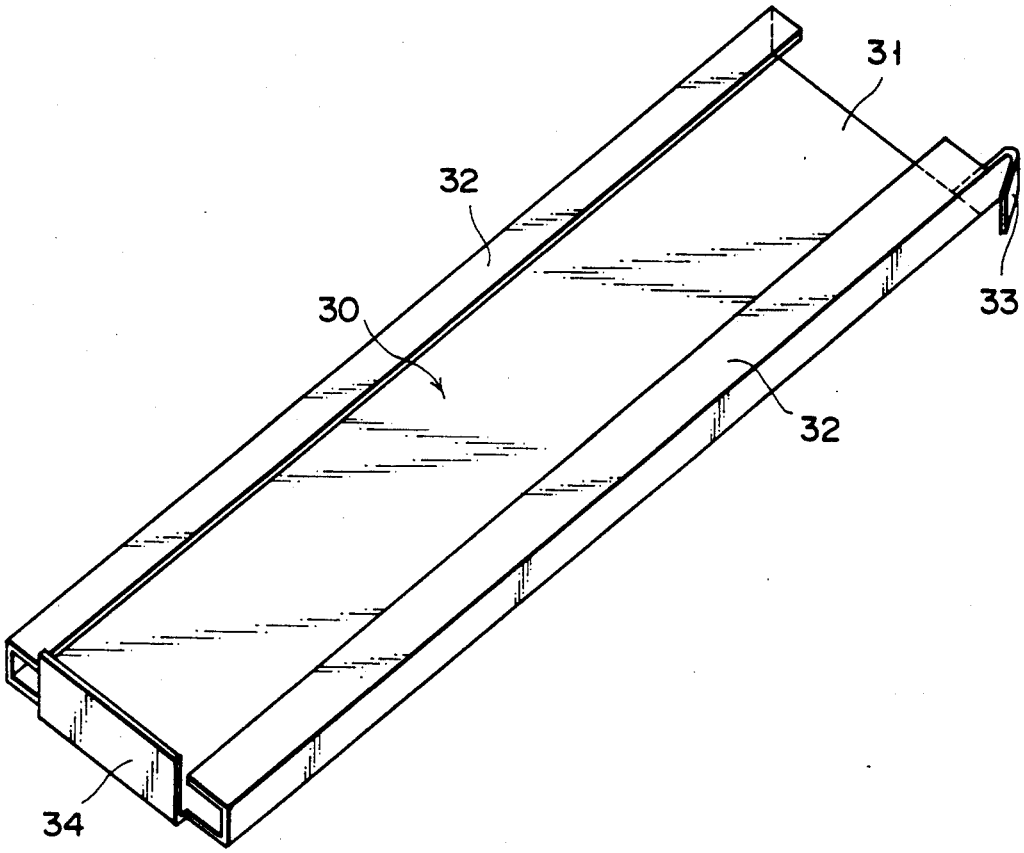

FIG. 12 shows a cover 30 which is used for removing the other cartridge from the device body. This cover 30 has a substrate 31 having substantially the same dimension as the lower plate of the cartridge, and guide rails 32 projected at both longitudinal side edges of the upper surface of the substrate 31. Each guide rail 32 extends over the corresponding side edge of a thin plate, and has an U-shaped cross-section so that the outer side surface and the upper and lower surfaces thereof can slidably guide the each flange 12 of the toner cartridge 2. A releasing member 33 for releasing a locking mechanism constructed by the above described projection 8 and the above described recess 16 is provided at one end of one guide rail 32. The releasing member is composed of an elastic piece extending externally rearwardly from one end of one guide rail 32. The elastic piece is preferably formed by bending one end of one guide rail 32. A stopper piece 34 is projected from the rear end of the inner surface of the substrate 31. In this embodiment, the substrate 31, the guide rails 32, the releasing member 33 and the stopper piece 34 are integrally formed of synthetic resin sheet. By the way, the releasing member 33 may be projected at the inner side of one guide rail 32.

The operation of the developing device constructed as described above will be described.

Figure 4:
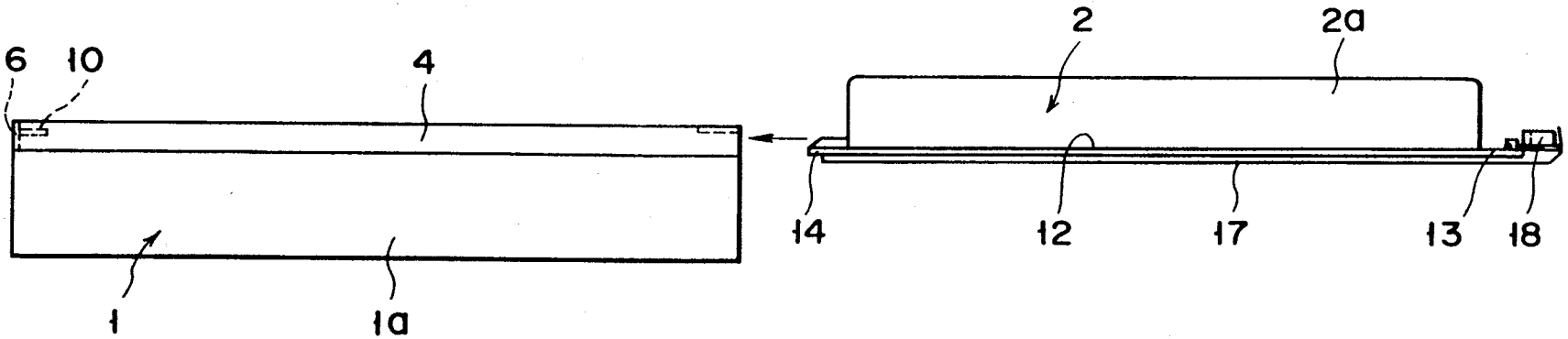
Figure 5:
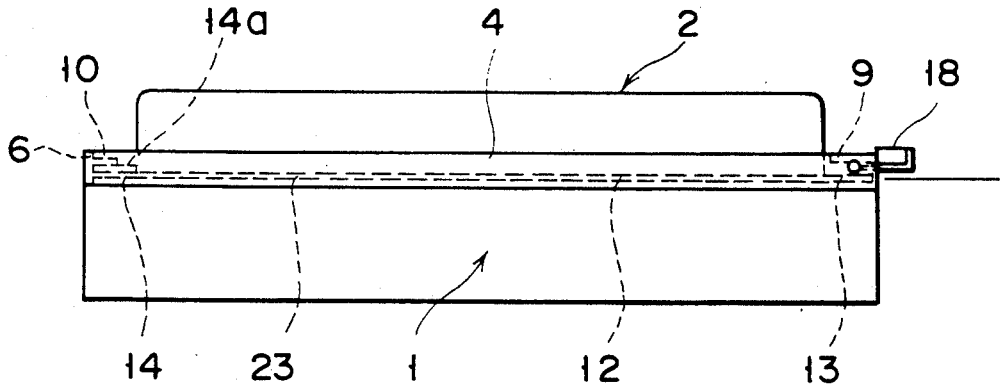
Figure 6:
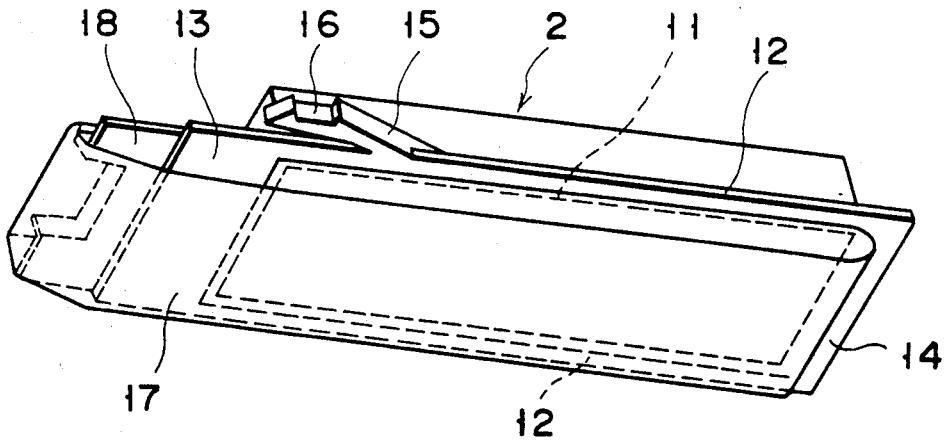
Figure 7:
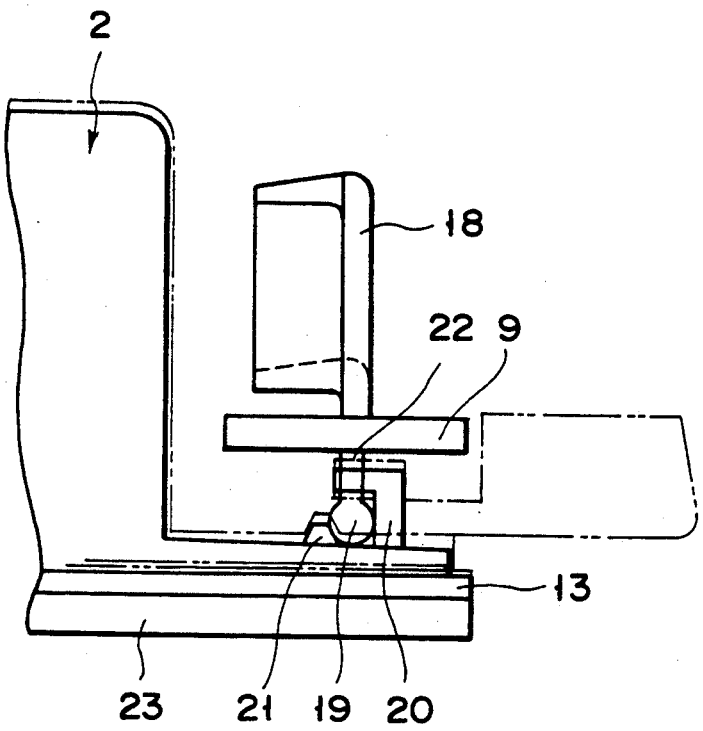

The toner cartridge 2 is firstly mounted in the device body 1. At this time, the pressing lever 18 provided at the toner cartridge 2 is located at the horizontal position, as shown in FIG. 4. As shown in FIGS. 4 and 11, the toner cartridge 2 is disposed laterally to the toner cartridge mounting port 5 of the device body 1, then the forward flange 14 of the toner cartridge 2 is placed on the gasket 23 disposed on the upper surface portion of the device body 1, and the toner cartridge 2 is slid toward the toner reception port 3 of the device body 1 with the flange 4 being directed in a leading direction. The outer sides of the both side flanges 12 of the toner cartridge 2 are brought into contact with the inner side surfaces of the guide rails 4, so that the toner cartridge 2 guided by guide rails 4 slides on the gasket 23. When the front flange 14 of the toner cartridge 2 collides with the stopper 6 provided at the rear portion of the device body 1 and the leading ends of the rising pieces 14*a* formed on the flange 14 are introduced into the lower side of the retaining piece 10 of the device body 1, the sliding movement of the toner cartridge 2 is stopped. The toner discharge port 6 of the toner cartridge 2 coincides with the toner reception port 4 of the device body 1 at the stopped position. At this time, as shown in FIG. 9, the rear end portion of the toner cartridge 2 arrives at the rear end portions of the guide rails 4 of the device body 1, and the elastic arm 15 provided at the toner cartridge 2 is brought into contact with the projection 8 of the wide portion 7 formed on one guide rail 4 so that the elastic arm 15 is elastically deformed to engage at its recess 16 with the projection 8 of the wide portion 7. Thus, the toner cartridge 2 is locked to the device body 1. In this state, the pressing lever 18 provided at the rear flange 13 of the toner cartridge 2 and the distal end of the strip-shaped sheet 17 are projected out from the toner mounting port 5 of the device body 1.

When the toner cartridge 2 is mounted in the device body 1 as described above, the toner cartridge 2 is slid on the gasket 23 provided on the device body 1 without any pressing force from the device body 1 being applied on the toner cartridge 2, and therefore the toner cartridge 2 can extremely and lightly make it sliding movement.

The distal end of the strip-shaped sheet 17 is then separated from the pressing lever 18 and is pulled rearwardly to drawn out the unbonded portion of the strip-shaped sheet 17 from the device body 1 through the gap between the toner cartridge 2 and the device body 1. At this time, the bonded portion of the strip-shaped sheet 17 bonded to the lower surface of the toner cartridge 2 is sequentially separated and externally drawn out from the device body 1. In this manner, the entire toner discharge port 11 of the toner cartridge 2 is opened, and toner filled in the toner cartridge 2 is discharged from the toner discharge port 11 into the device body 1 through the toner reception port 3 of the device body 1.

The pressing lever 18 is then operated as described below to press the lower surface of the toner cartridge 2 on the gasket 23 provided on the device body 1. When the cartridge is mounted, the pressing lever 18 is disposed at the horizontal position, as shown in FIG. 9, and the shoulders 22 of the pressing lever 18 are located at the lower side of the retaining pieces 9 formed at the rear end portion of the guide rails 4 of the device body 1. In this state, the pressing lever 18 is operated to be rotated around the shaft 19 from the horizontal position shown in FIGS. 1 to 3, and 7 to 9 to the vertical position. The shoulders 22 formed on the pressing lever 18 are moved to the erected position with the pressing lever 18 being rotated to the vertical position, and the upper surfaces of the shoulders 22 are brought into contact with the lower surfaces of the retaining pieces 9 formed at one end portions of the guide rails 4 of the device body 1, as shown in FIG. 10. Since the vertical distance l over between each shoulder 22 and the shaft 19 is set longer than the distance L between the upper surface of the flange 13 of the toner cartridge 2 placed on the gasket 23 and the lower surface of each retaining piece 9, the shoulders 22 and the shaft 19 are pressed against the flange 13 and the retaining pieces 9.

In this state, the retaining pieces 9 are fixed, while the flange 13 of the toner cartridge 2 is vertically displaceable on the gasket 23 having elasticity. Therefore, the flanges 13 of the toner cartridge 2 are pressed down by both ends of the shaft 19 from above, so that the toner cartridge 2 is displaced toward the flange 13 to compress the gasket 23 from above. In this case, the downwardly displacing distance of the flange 13 is the difference between the vertical distance l over each shoulder 22 and the shaft 19, and the distance L between the upper surface of the flange 13 of the toner cartridge 2 placed on the gasket 23 and the lower surface of each retaining piece 9, and that difference is a compressed amount of the gasket 23 when the gasket 23 is compressed by the flange 13.

Therefore, when the flange 13 of the toner cartridge 2 presses the gasket 23, a portion of the flange 12 of the toner cartridge 2 located near to the flange 13 hence presses the gasket 23. Further, as described above, the rising pieces 14*a* formed at the front flange 14 of the toner cartridge 2 are introduced into the lower side of the retaining piece 10 of the rear end of the device body 1 and are brought into contact with the lower surface of the retaining piece 10. Therefore, the retaining piece 10 presses down the flange 14 from above through the rising pieces 14*a*, and the flange 14, similarly to the flange 13, press the gasket 23. Since the flange 14 of the toner cartridge 2 presses the gasket 23, a portion of the flange 12 of the toner cartridge 2 located near to the flange 14 presses the gasket 23.

In this manner, the entire gasket 23 is pressed by the flanges of the toner cartridge 2 to be compressed sufficiently.

Therefore, the flanges 12 to 14 of the toner cartridge 2 are sufficiently brought into contact with the gasket 23 to securely seal between the toner cartridge 2 and the device body 1, so that the toner is prevented from being leaked out.

In this state, since the toner cartridge 2 is pressed by the pressing lever 18 and the retaining piece 10 and is fixed in the device body, it is not necessary to construct the guide rails 4 to retain the flanges of the cartridge 2 from side and above as the conventional device.

Toner supplied into the device body 1 is supplied from the toner supply port of the device body 1 to a photosensitive member. When the amount of the toner stored in the device body 1 is reduced from the result of the toner supply to the photosensitive member and a new supply of toner is needed, the wasted toner cartridge 2 mounted in the device body 1 is removed from the device body 1, and a new toner cartridge 2, in place of the wasted toner cartridge 2, is mounted in the device body 1. When the wasted toner cartridge 2 is removed from the device body 1, the pressing lever 18 is rotated to the horizontal position to release the retention of the flanges of the toner cartridge 2, and the toner cartridge 2 is then slid along the guide rails 4 to be drawn out from the toner cartridge mounting port of the device body 1. At this time, if the cover 30 shown in FIG. 12 is used, it can prevent the toner attached to the inner surface of the cartridge 2 from leaking out from the cartridge to contaminate the device body and the environment around the device body. A method of using the cover 30 will be described with reference to FIGS. 13 and 14.

Figure 13:
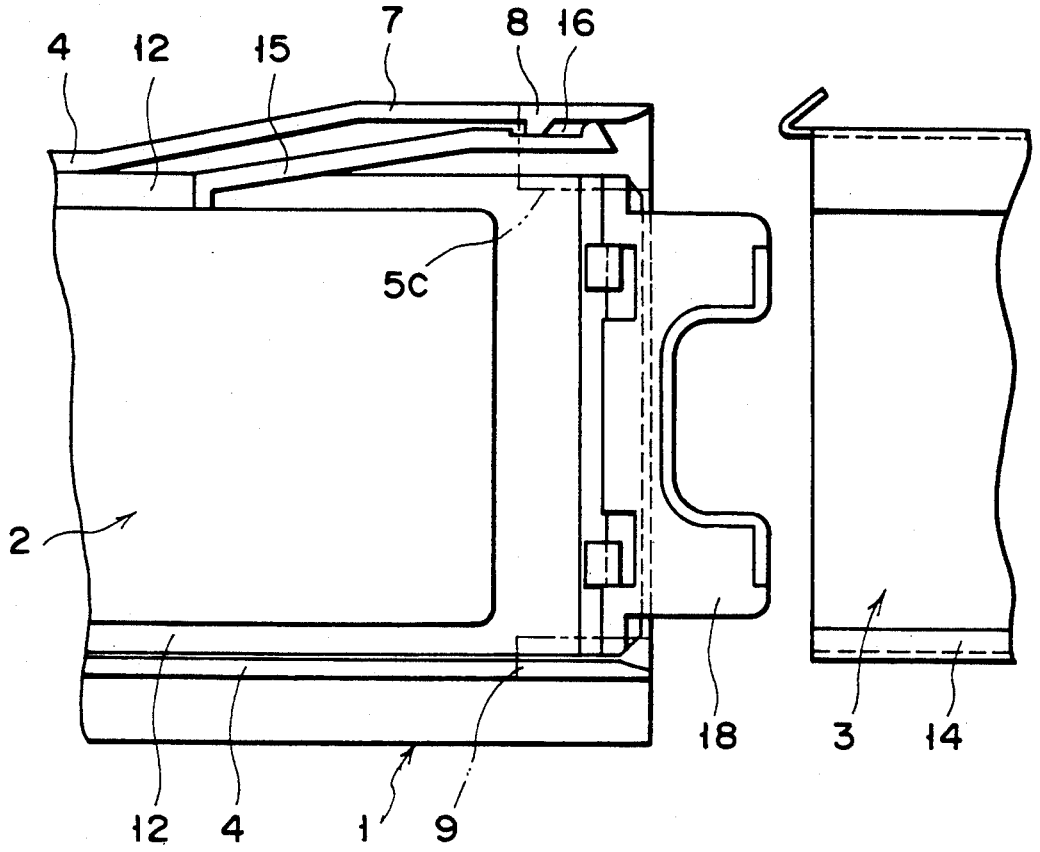
Figure 14:
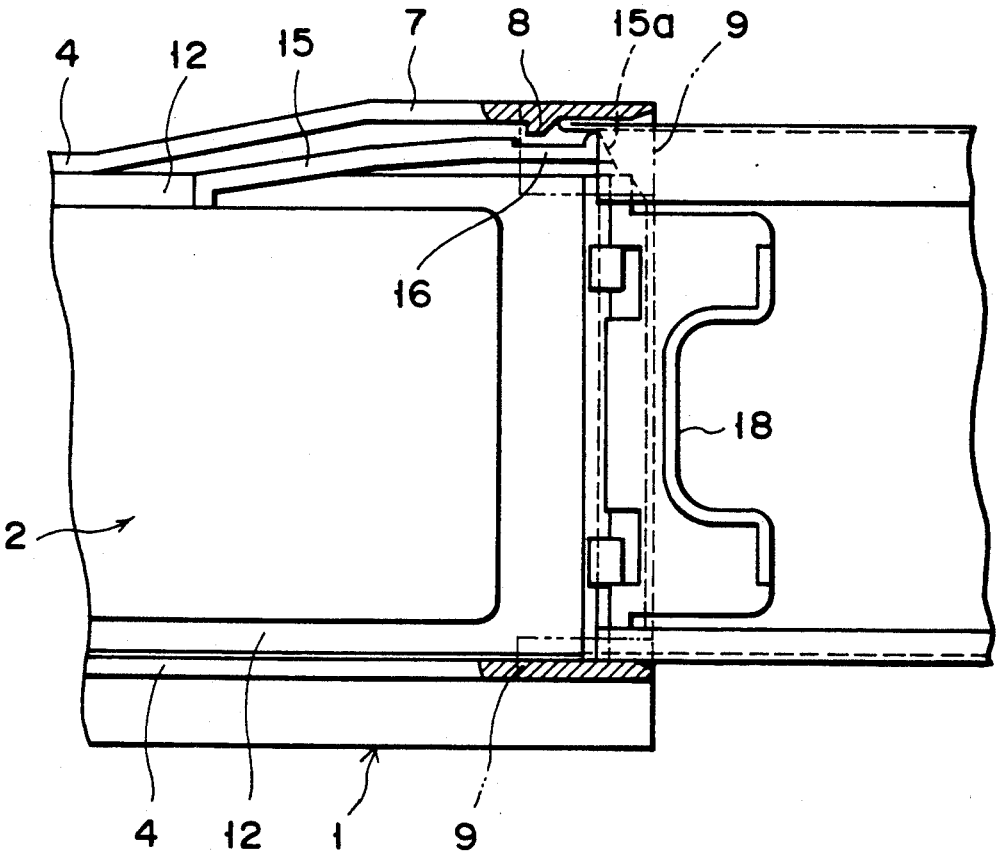

After the handle 18 is rotated to the horizontal position, the cover 30 is disposed horizontally at a forward position of the device body 1 to oppose the cartridge 2, as shown in FIG. 13. The cover 30 is then shifted forwardly, and the releasing member 33 thereof is inserted between the distal end of the elastic arm 15 of the locking mechanism and the distal end of the wide portion 7, and the elastic arm 15 is shifted inwardly as shown in FIG. 14. As a result, the locking mechanism is released, and the cartridge 2 becomes free with respect to the device body 1. By pulling rearwardly cartridge 2 the flanges 12 are introduced into the guide rails 32 to be able to be guided. When the cartridge 2 is further pulled, the flanges 12 are removed from the guide rails 4 of the device body 1 and moved into the guide rails 32 of the cover 30 to be guided. At this time, the toner discharge port of the cartridge is removed gradually from the upper surface of the device body, and is covered with the substrate 31 of the cover 30 as soon as the toner discharge port is perfectly removed from the upper surface. As a result, it can prevent the toner from leaking out from the toner discharge port.

A mechanism for pressing the gasket by pressing the toner cartridge is not limited to the above described embodiment.

In the embodiment described above, the toner cartridge is of the type in which the toner cartridge is slidably mounted in the device body. However, the present invention is not limited to the embodiment. For example, the embodiment may be of the type in which a toner cartridge is placed on the upper surface of a device body from above.

A mechanism for locking the toner cartridge to the device body is not limited to the embodiment described above.

The arrangements of the device body and the toner cartridge are not limited to the embodiment described above.

According to the present invention as described above, the toner cartridge can be lightly moved to a predetermined mounting position of the device body without strong frictional resistance when the toner cartridge is mounted in the device body. Further, the toner cartridge can be sufficiently tightly fitted on the sealing member by operating the pressing mechanism to press the cartridge on the sealing member when the toner cartridge is arrived at the predetermined mounting position. Therefore, the operability of the developing device when the toner cartridge is moved is good, and the developing device above sufficiently seals between the toner cartridge and the device body when the toner cartridge is mounted in the device body.

Additional advantages and modifications will readily occur to those skilled in the art. Therefore, the invention in its broader aspects is not limited to the specific details, and representative devices, shown and described. Accordingly, various modifications may be made without departing from the spirit or scope of the general inventive concept as defined by the appended claims and their equivalents.

What is claimed is:

1. A developing device comprising:

a device body having a toner reception port for receiving toner to be supplied therein to a photosensitive member;

a toner cartridge, having a toner discharge port, detachably mounted on said device body such that said toner discharge port is opposed to said toner reception port, for supplying toner to said device body through said toner discharge port and said toner reception port;

a sealing member mounted on said device body surrounding said toner reception port for providing a seal between said device body and said toner cartridge mounted on said device body; and means, provided on said toner cartridge, for compressing said sealing member between said toner cartridge and said device body when said toner cartridge is mounted on said device body, wherein said compressing means includes a lever rotatably mounted on said toner cartridge for pressing said toner cartridge against the device body by rotating the lever.

2. The developing device according to claim 1, wherein said toner cartridge includes a case having said toner discharge port, and flanges externally projecting from said case for compressing said sealing member, and said device body includes a case having said toner reception port, and means for slidably guiding said flanges along said device body so that the toner discharge port is opposed to the toner reception port.

3. The developing device according to claim 2, wherein said lever is rotatably supported at one end of said flanges, and said device body including means, being brought into contact with the lever when the lever is rotated, for shifting the flanges toward said sealing member by a force exerted through the lever.

4. A developing device comprising:

a device body having a toner reception port for receiving toner and supplying toner to a photosensitive member;

a toner cartridge, having a toner discharge port, detachably mounted on said device body such that said toner discharge port opposes said toner reception port, for supplying toner to said device body through said toner discharge port and said toner reception port;

a cover mounted on said toner cartridge when said toner cartridge is removed from said device body, for sealing said toner discharge port of said toner cartridge; and a locking mechanism for locking said device body and said toner cartridge mounted on said device body to each other, and means, provided on said cover, for releasing said locking mechanism.

5. A developing device comprising:

a device body including a case having a toner reception port, for supplying toner to a photosensitive member;

a toner cartridge detachably mounted on the device body, including a container in which toner is stored and which has a toner discharge port, the toner discharge port being opposed to the toner reception port when the toner cartridge is mounted on the device body;

means for guiding the toner cartridge along the case of the device body for mounting the toner cartridge on the device body; and a sealing member mounted on the case of the device body surrounding the toner reception port for sealing the case of the device body and the container of the toner cartridge to each other; and said toner cartridge including means, provided on the container, for engaging the guiding means to press the container of the toner cartridge against the sealing member.

6. A developing device comprising:

a device body including a case having a toner reception port for supplying toner to a photosensitive member;

a toner cartridge detachably mounted on the device body, including a container in which toner is stored and which has a toner discharge port, the toner discharge port being opposed to the toner reception port when the toner cartridge is mounted on the device body;

means for guiding the toner cartridge along the case of the device body for mounting the toner cartridge on the device body; and a sealing member mounted on the case of the device body surrouding the toner reception port for sealing the case of the device body and the container of the toner cartridge to each other;

said toner cartridge including means, provided on the container, for engaging the guiding means to press the container of the toner cartridge against the sealing member;

wherein said engaging means includes a pair of elongated flanges externally projecting from the container of the toner cartridge, and said guiding means includes a pair of elongated guide rails projecting from the case of the device body for slidably guiding the flanges along the device body for mounting the toner cartridge on the device body thereby pressing the container against the sealing member.

7. The developing device according to claim 6 further comprising means for engaging the flanges and guide rails with each other to lock the toner cartridge against the device body.

8. The developing device according to claim 6 wherein the container of the toner cartridge includes a front end from which the container is guided along said guide rails for mounting the toner cartridge on the device body, and a rear end from which the container is guided along the guide rails for detaching the toner cartridge from the device body, and said engaging means further includes a handle provided on the rear end of the container, the handle being rotatable between first and second positions, and having a movable portion for contacting the guide rail to compress the sealing member between the device body and container when the handle is rotated to the first position.

* * * * *